United States Patent [19]

Powers et al.

[11] Patent Number: 4,709,613

[45] Date of Patent: Dec. 1, 1987

[54] VARIABLE TENSIONING MECHANISM FOR DRUM HEAD

[76] Inventors: Steven Powers, 205 E. 67th St., New York, N.Y. 10023; Morton Breier, Memory La., Greenwich, Conn. 06831

[21] Appl. No.: 897,668

[22] Filed: Aug. 18, 1986

[51] Int. Cl.[4] ..... G10D 13/02

[52] U.S. Cl. ..... 84/413; 84/411 A; 84/421

[58] Field of Search ..... 84/411–421

[56] References Cited

U.S. PATENT DOCUMENTS

| | | | |
|---|---|---|---|
| 583,372 | 5/1897 | Henderson | 84/411 R |
| 1,054,009 | 2/1913 | Ludwig | 84/419 |
| 2,204,987 | 6/1940 | Gussak | 84/412 |
| 3,185,013 | 5/1965 | Gussak | 84/411 R |
| 3,861,265 | 1/1975 | Van der Wyk | 84/411 R |
| 4,077,297 | 3/1978 | Woodson | 84/411 R |
| 4,122,748 | 10/1978 | May | 84/411 A |
| 4,154,136 | 5/1979 | McIntyre | 84/411 A |
| 4,377,964 | 3/1983 | Glassford | 84/411 R |
| 4,616,551 | 10/1986 | Bookvich | 84/411 A |
| 4,635,524 | 1/1987 | Allen et al. | 84/419 |

*Primary Examiner*—Lawrence R. Franklin

*Attorney, Agent, or Firm*—Stiefel, Gross, Kurland & Pavane

[57] ABSTRACT

A head tensioning mechanism (10) for varying the tension on a drum head (14) during play is disclosed. In a preferred embodiment, the head tensioning mechanism (10) incorporates a pair of paddles (52) extending along opposite sides of the drum body (28) such that the paddles (52) may be squeezed between the legs of the player for variably adjusting the head tension in response to the squeezing pressure applied by the player. A device for supporting the drum in an upright position and incorporating a treadle (82) for operating the variable head tensioning mechanism (10) in response to foot pressure is also disclosed.

24 Claims, 10 Drawing Figures

FIG. 1
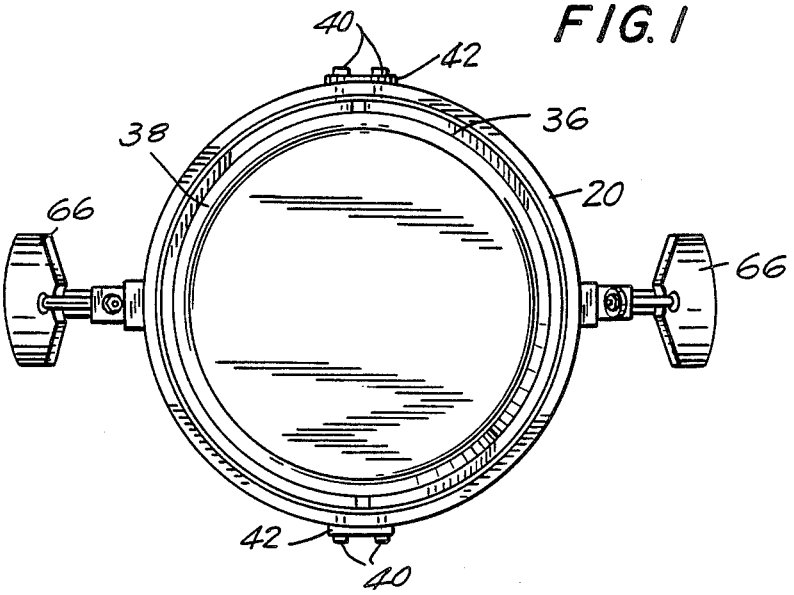
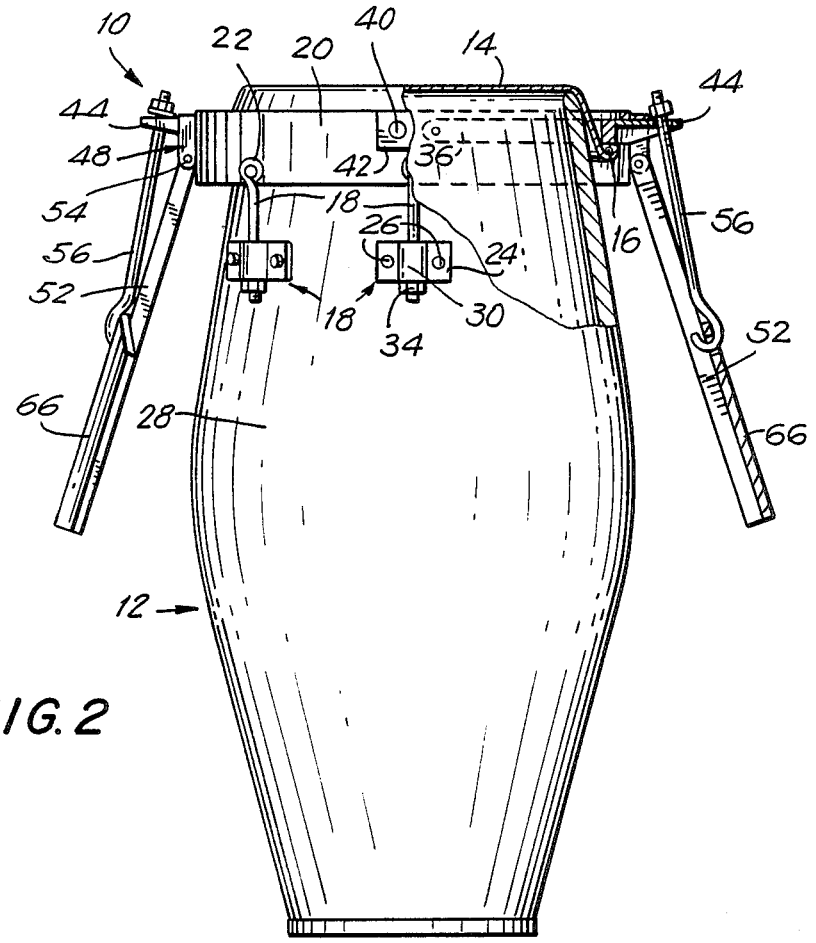
FIG. 2

VARIABLE TENSIONING MECHANISM FOR DRUM HEAD

BACKGROUND OF THE INVENTION

1. Field of the Invention

This invention pertains to drums, and more particularly to devices for variably tensioning the drum head during play.

2. Description of Prior Art

It is well known that the pitch of a drum is determined by the tension on the drum head. Typically, while the tension on the drum head is adjustable, adjustment of the head tension is a time consuming process. Consequently, it is not possible to vary the tension on the drum head during play. Typically, for example, the drum head overlies one open end of the drum, and the periphery of the drum head is secured to a hoop. A ring seated on the hoop is secured to the drum body by a plurality of lugs distributed thereabout. Tightening of the drum lugs pulls the ring downward which, seating on the drum head hoop, urges the hoop downward thereby increasing the tension on the drum head. Obviously, tightening or loosening all of the drum lugs for varying the tension on the drum head is a time consuming process.

Through the years, various alternative arrangements for varying the tension on a drum head have been proposed. An early example is found in U.S. Pat. No. 583,372 which discloses a tensioning mechanism incorporating complex linkages which may be tightened or loosened by a hand actuated ratchet.

In U.S. Pat. No. 2,204,987, top and bottom drum heads are maintained under tension by a plurality of tension wires extending the length of the drum body. The central portion of the drum body is recessed such that the tension wires may be pressed inwardly, as by the legs or arms of the player, for applying increased tension to the drum head.

U.S. Pat. No. 3,861,265 discloses a leg actuated mechanism for increasing tension on the drum head. Essentially, the device employs a lever arm having a pressure device at one end which abuts the drum head. When the free end of the lever arm is moved, as under the urging of the player's leg, the pressure device at the other end of the lever presses into the drum head for increasing the drum head tension.

U.S. Pat. No. 4,122,748 discloses a complex mechanism insertable in one end of a drum. The device includes a threaded supporting rod disposed along the axis of the drum and a hoop threadably secured to the supporting rod for rotation thereabout. The hoop is secured to the drum head such that as the hoop rotates about the supporting rod, its upward or downward movement varies the drum head tension.

U.S. Pat. No. 4,154,136 discloses yet another arrangement for varying the tension on a drum head during play. The devices includes a tension band which may be rotated about the drum body by manipulating an adjustment knob. A plurality of angled slots in the tension band function as cams, each slot receiving a nut which acts as a cam follower. The nuts are connected through intermediate means to the drum head hoop such that upward and downward movement of the cam followers in the slots upon rotation of the tension band serves to adjust the tension on the drum head.

SUMMARY OF THE INVENTION

The present invention is for a mechanism which allows the tension on the drum head to be varied while the instrument is being played. In its preferred form, the tension mechanism in accordance with the present invention is readily retrofitted on an existing drum, such as a conga drum, by employing the standard drum head, drum head hoop and drum lugs such that no permanent alteration to the drum body is required. In this embodiment, the variable head tensioning mechanism of the invention comprises an outer ring having an internal diameter greater than the outer diameter of the hoop, and a pair of inner half rings disposed about the drum body inside the outer ring and collectively defining a diameter substantially that of the hoop. The free ends of the inner rings are in confronting relation and secured to the outer ring for pivotal movement relative thereto. A pair of paddles extend along opposite sides of the drum body, each paddle being secured at one end to one of the inner half rings.

In use, the head tensioning mechanism is fitted over the drum body with the lower edge of the inner half rings seating on the drum head hoop. The outer ring, which is provided with a plurality of spaced apertures, is then secured to the drum body by the standard drum lugs. As the paddles are squeezed together, as by the legs of the player, the inner half rings are pivoted downwardly relative to the outer ring, which is retained in position by the drum lugs. Inasmuch as the inner half rings seat on the drum head hoop, downward movement of the inner half rings applies additional tension on the drum head thereby increasing the pitch of the drum. Consequently, the tension on the drum head may be continuously varied by varying the amount of squeezing pressure applied to the paddles by the legs of the user. The tensioning mechanism of the invention also incorporates a stop means for limiting upward movement of the inner half rings relative to the outer ring. The initial tension on the drum head is set by tightening the standard lugs thereby pulling the outer ring downward which, acting through the stop means, serves to pull the inner half rings and hence the drum head hoop downward.

The present invention further comprises a device for supporting a drum incorporating the variable head tensioning mechanism of the invention in an upright position for accommodating play of the drum while the player is standing. To this end, the device incorporates a treadle secured, as by cables, to the paddles such that the drum head tension may be continuously varied during play by the application of appropriate foot pressure to the treadle.

Further features and advantages of the variable head tensioning mechanism of the present invention and the device for supporting same will be more fully apparent from the following detailed description and annexed drawings of the presently preferred embodiments thereof.

BRIEF DESCRIPTION OF THE DRAWINGS

FIG. 1 is a top plan view of a conga drum fitted with the variable head tensioning device in accordance with the present invention;

FIG. 2 is a side elevation thereof;

DETAILED DESCRIPTION OF PREFERRED EMBODIMENTS

Figures 3, 4:
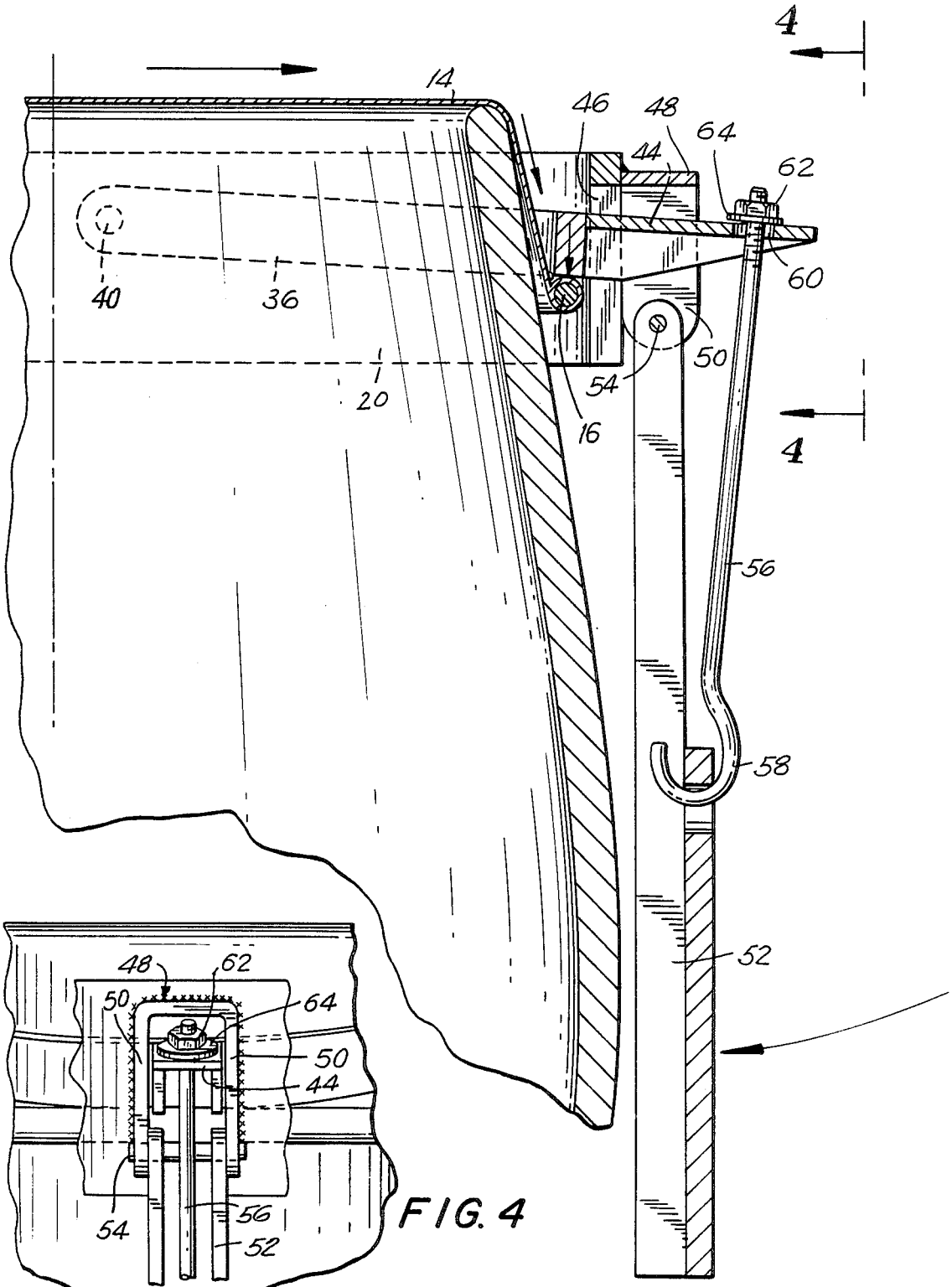
FIG. 3 is a fragmentary sectional view illustrating the tensioning mechanism in greater detail.
FIG. 4 is a view taken substantially along the line 4—4 in FIG. 3.

Referring now to the drawings, and initially to FIGS. 1-4 thereof, the tensioning mechanism in accordance with the present invention, generally designated at 10, is shown fitted on a conga drum 12.

The tensioning mechanism 10 is particularly adapted for retrofitting on a standard conga drum 12, and to that end the tensioning mechanism 10 utilizes certain elements found on the conga drum, namely, the drum head 14, the drum head hoop 16 and the plurality of drum lugs 18, of which typically five are distributed equidistantly about the circumference of the drum shell or body 28. The drum head 14 extends over the open upper end of the conga drum 12 and its periphery is secured, in a conventional manner, to the hoop 16. Each drum lug 18 comprises a bracket 24 secured as by bolts 26 to the drum shell 28, each bracket 24 including a central hump 30 which receives the threaded lower end of a connecting rod 32. A nut 34 secured to the threaded lower end of each connecting rod 32 blocks upward movement of the rod 32 relative to the bracket 24. The upper end of each rod 32 is hook-shaped.

Also shown in the drawings is an outer ring 20 having a plurality of apertures 22 spaced for alignment with the hook-shaped connecting rods 32. Outer ring 20, which comprises part of the tensioning mechanism 10 of the invention, is similar to the standard ring found on most conga drums though, for reasons that will be apparent hereinafter, outer ring 20 is of somewhat greater diameter than the standard ring.

In a conventional conga drum, wherein the ring 20 is of smaller diameter, the lower edge of the ring seats on the drum head hoop 16 and the hooked upper ends of the connecting rods 32 are received in apertures in the ring. In this arrangement, upward movement of the ring is restricted by the rods 32, while downward movement is restricted by the tension of the drum head 14. Tension on the drum head 14 is set by raising and lowering the ring 20, which is accomplished by loosening and tightening, respectively, the nuts 34. While this arrangement serves its intended purpose, it will be apparent that changing the head tension in this fashion is time consuming. As a consequence, it is not possible to vary the tension on the drum head 14, and hence vary the pitch of the drum, while the instrument is being played.

Turning to the tensioning mechanism 10 of the invention, as noted the mechanism 10 includes an outer ring 20 of greater diameter than the tensioning ring found on a standard drum. Consequently, and as best illustrated in FIG. 3, the outer ring 20 is disposed outside, not on, drum head hoop 16. The tensioning mechanism 10 also includes a pair of half rings 36, 38 disposed in confronting relation about the drum shell 28 inside the outer ring 20. As best shown in FIG. 3, the half rings 36, 38 are of substantially the same radius as the hoop 16 such that when half rings 36, 38 are disposed inside the outer ring 20, their lower edges rest on the hoop 16.

The half rings 36, 38 are secured near their ends for pivotal movement relative to the outer ring 20. As shown, such pivotal securement may be accomplished by bolts 40 which pass with clearance through holes in the outer ring 20 and are threaded in aligned holes in the half rings 36, 38. A pair of strengthening brackets 42 are preferably positioned between the heads of bolts 40 and the outer ring 20.

As best shown in FIG. 3, a flange 44 is secured to and extends radially outward from each half ring 36, 38 substantially at the midpoint thereof. Assuming that the components of the tensioning mechanism 10 are comprised of metal, which is presently preferred, the flanges 44 may be secured to the half rings 36, 38 as by welding or brazing. The flanges 44 pass through the outer ring 20 through aligned openings 46 in the outer ring. As best shown in FIG. 3, and for reasons that are explained below, each opening 46 preferably extends from the bottom of the outer ring 20 to a point near the top thereof to provide a wide range of sliding movement of flange 44 in slot 46. As best shown in FIGS. 3 and 4, an inverted U-shaped bracket 48 is secured, as by welding or brazing, to the outer face of ring 20 about each opening 46. The flanges 44 are of sufficient length to pass through the space between the legs 50 of the bracket 48 and beyond.

An elongate paddle 52 is pivotally secured to the lower end of each U-shaped bracket 48. As best shown in FIG. 4, each paddle 52 preferably comprises an extruded U-shaped member, the legs of which are received inside the legs 50 of the bracket 48. Pivotal securement of each paddle 52 to its respective bracket 48 may be accomplished by a bolt 54 which passes through the legs 50 of the bracket 48 and the legs of the paddle 52.

As best illustrated in FIGS. 2 and 4, a tensioning rod 56 connects each paddle 52 to its respective flange 44. Each tensioning rod 56 has a hook 58 at its lower end which extends through an aligned aperture in its respective paddle 52. The upper end of each tensioning rod 56 is threaded and extends through an aperture 60 provided for that purpose near the free end of its corresponding flange 44. The tensioning rods 56 are secured to the flanges 44 by nuts 62 and intervening spherical washers 64. As shown, an enlarged paddle actuator 66 is preferably secured to the lower end of each paddle 52.

The tensioning mechanism 10 is easily retrofitted on an existing conga drum by loosening the lug nuts 34, removing the standard tensioning ring, and then sliding the mechanism 10 over the drum head until the lower edges of the half rings 36, 38 seat on the drum head hoop 16. The tensioning mechanism 10 is then rotated as necessary until the apertures 22 are aligned with the connecting rods 32 whereupon the hooked upper ends of the connecting rods are fitted in the apertures 22 in the conventional manner. The nuts 34 are then tightened as necessary to set the initial tension on the drum head 14. It will be apparent that as the nuts 34 are tightened, the rods 32 pull down on the outer ring 20 which, through flanges 44 and bolts 40, pulls down on the half rings 36, 38. Since the half rings 36, 38 seat on the drum head hoop 16, as the inner rings 36, 38 move downward, increasing tension is applied to the drum head 14.

Once the initial tension of the drum head 14 is set, the tensioning mechanism 10 allows the tension on the drum head 14 to be varied as the instrument is played. In the embodiment illustrated in FIGS. 1–4, it is contemplated that the conga drum will be held between the legs of the player. As the player squeezes his legs against the paddle actuators 66, the paddles 52 pivot about the bolts 54 towards the drum body 28. Simultaneously, the tensioning rods 56 pull down on the flanges 44 which, in turn, move downward in openings 46. As the flanges 44 are secured to the half rings 36, 38, downward movement of the flanges 44 in the slots 46 causes the half rings 36, 38 to pivot downwardly about the bolts 40. This downward pivotal movement of the half rings 36, 38 urges the drum head hoop 16 downward thereby increasing the tension on the drum head 14. It will therefore be apparent that the player may variably adjust the tension on the drum head 14 for varying the pitch of the drum by simply adjusting the squeezing pressure applied to the paddle actuators 66. It will also be apparent that the length of the paddles 52 provides considerable mechanical advantage when the player compresses the paddles between his knees for increasing the tension on the drum head.

FIGS. 5–10 illustrate a transport device 80 for a conga drum 12 fitted with the tensioning mechanism 10 of the present invention. The transport device 80 is designed to support the drum 12 in an upright position for use while the player is standing, and to this end incorporates a treadle 82 for accommodating foot operation of the tensioning mechanism 10 as will be more fully explained below.

Figure 5:
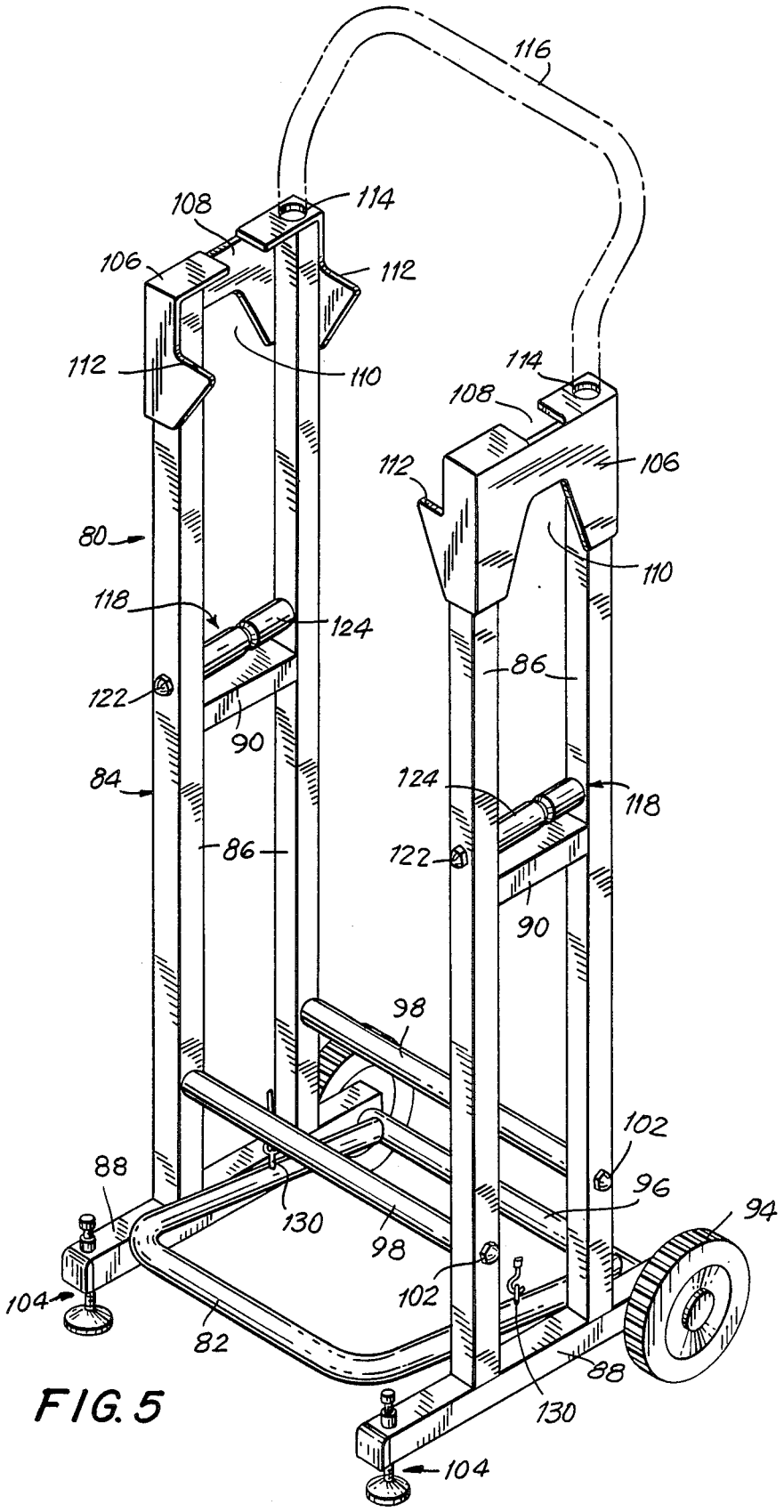
FIG. 5 is a perspective view of a transport device for accommodating play of the drum of FIG. 1 in the upright position.
Figure 7:
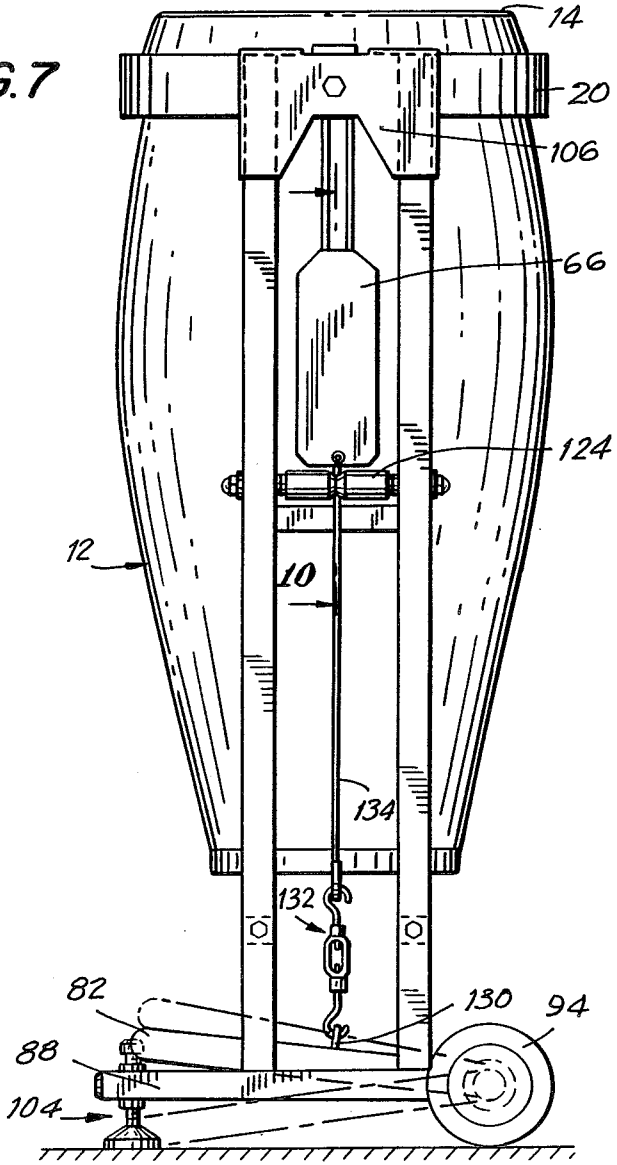
FIG. 7 is a side elevation view thereof.
Figure 6:
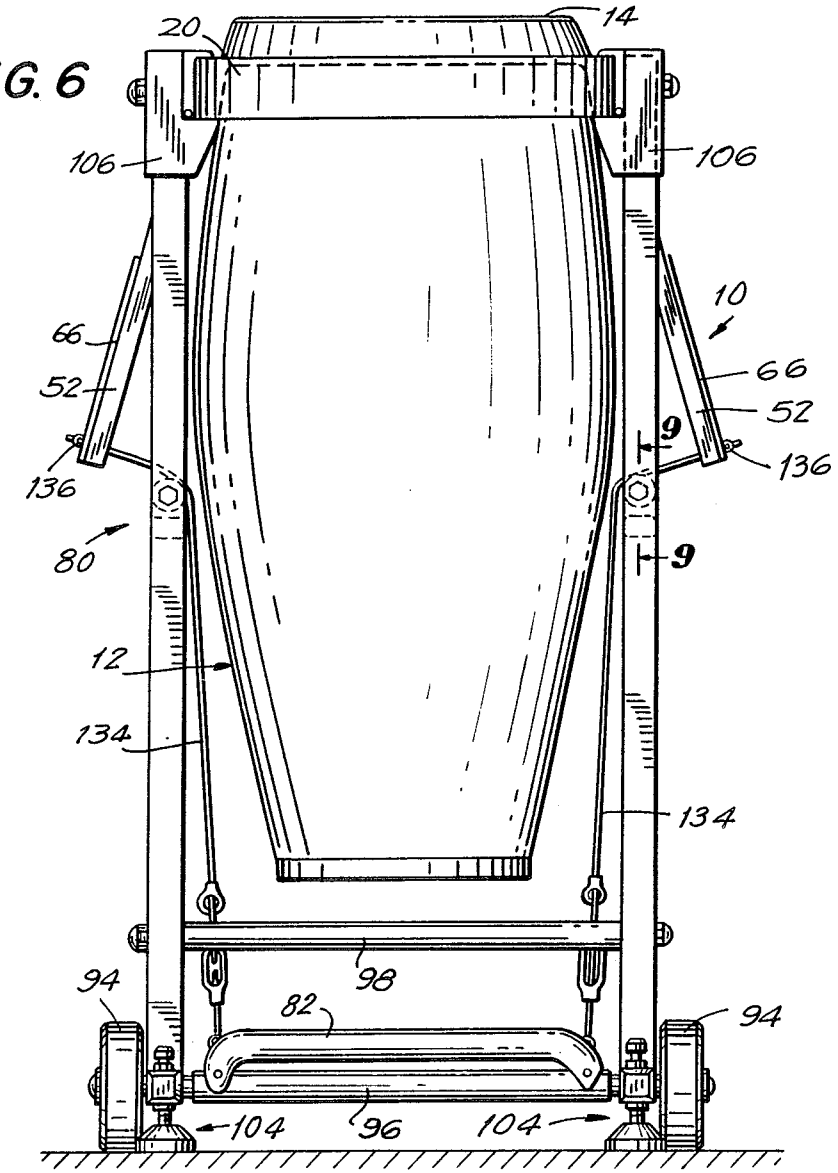
FIG. 6 is a front elevation view thereof.

As seen in FIGS. 5–7, the transport device 80, which has the general appearance of a hand truck, includes a frame 84 comprising four vertical members 86 and two base members 88. As shown, the base members 88 are disposed on either side of the device 80 and each is joined to the lower ends of a pair of vertical members 86 for defining a generally rectangular space within the frame 84. Struts 90 extend between each pair of vertical members 86 at or near their midpoints for providing additional structural integrity. Vertical members 86, base members 88 and struts 90 are preferably comprised of square steel tubing joined together as by welding or brazing. Additional structural support is provided by a pair of tubular struts 98 extending between the front and rear pairs of vertical members 86. The tubular struts 98 are located near the bottom of the frame 84 to avoid interference with the drum 12 and are secured in place by threaded rods (not shown) fitted with nuts 102, the rods extending through the tubular struts 98 and aligned apertures in the vertical members 86.

Figure 8:
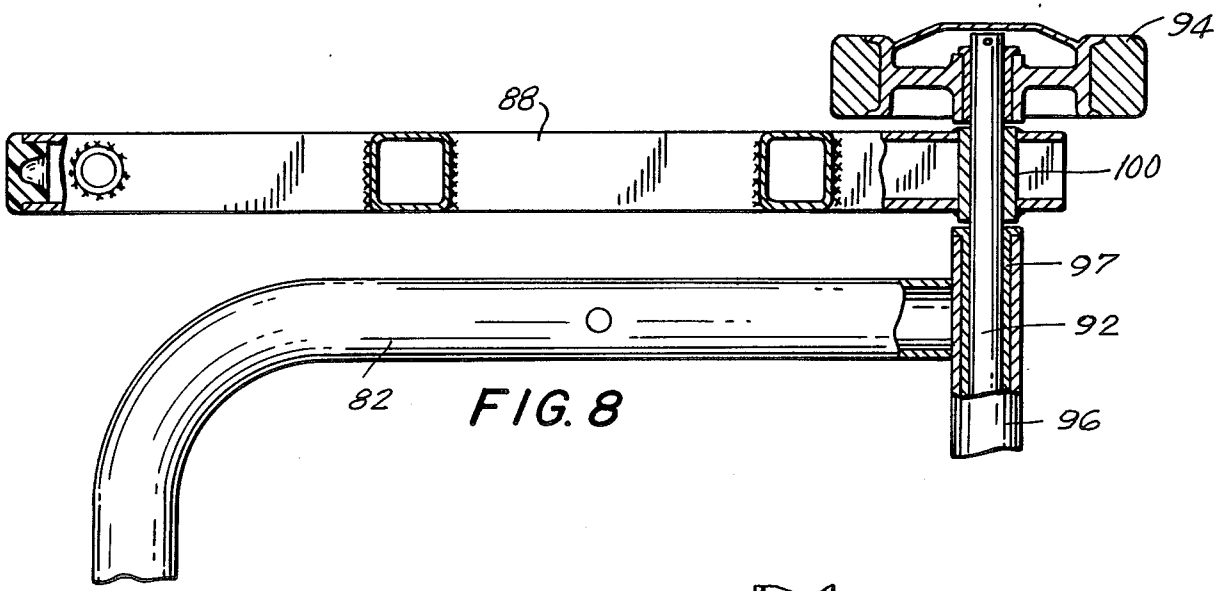
FIG. 8 is a fragmentary view, partly in section, illustrating the treadle and axle thereof.

Frame 84 further comprises an axle 92 extending through aligned holes fitted with bushings 100 near the back of the base members 88. A pair of wheels 94 are secured to the ends of the axle 92. As best shown in FIG. 8, a steel tube 96 surrounds the axle 92 and is supported thereabout by bushings 97 disposed in the ends of the steel tube 96 for accomodating relative rotation between axle 92 and tube 96. The treadle 82 preferably comprises bent steel tubing joined at either end, as by welding, to the tube 96. Because the tube 96 is supported for rotation relative to the axle 92, the treadle 82 is free to move in the manner illustrated by the solid and dotted lines in FIG. 7. A pair of adjustable feet 104 of a type well known in the art are fitted to the ends of the base members 88 opposite the wheels 94 for leveling the device 80 in its upright position.

A pair of cap members 106, one on either side of the frame 84, overlie the upper ends of the vertical members 86. As shown, each cap member 106 includes an upper central cutout 108, a lower central cutout 110, a pair of inwardly directed shoulders 112, and a hole 114 aligned with the bore of its respective rear vertical member 86. The bores of the rear vertical members 86 aligned with the holes 114 are dimensioned for a force fit with the ends of a removable handle 116.

Figure 9:
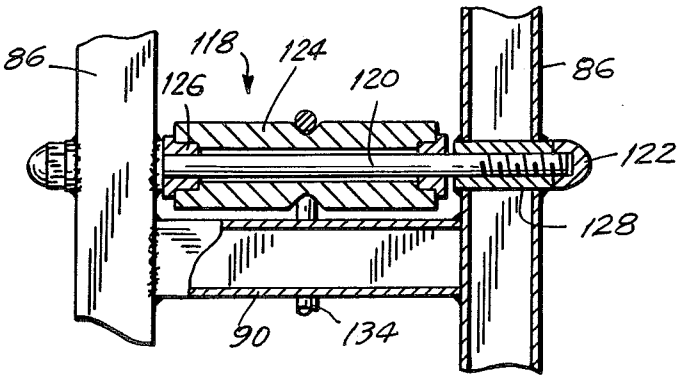
FIG. 9 is a fragmentary view, partly in section, illustrating one cable guide thereof.

A pair of cable guides 118 are secured to the frame 84, one above each strut 90. As best shown in FIG. 9, each cable guide 118 comprises a rod 120 extending through aligned holes in its corresponding pair of vertical members 86. A short length of tubing 128 is preferably welded in the aligned holes in the vertical members 86 for supporting the ends of the rod 120. The rod 120 is threaded at both ends for receiving nuts 122 for securing the rod 120 in place. A center notched spool 124 is supported for rotation about the rod 120 by a pair of bushings 126, one at either end of the spool 124.

Figure 10:
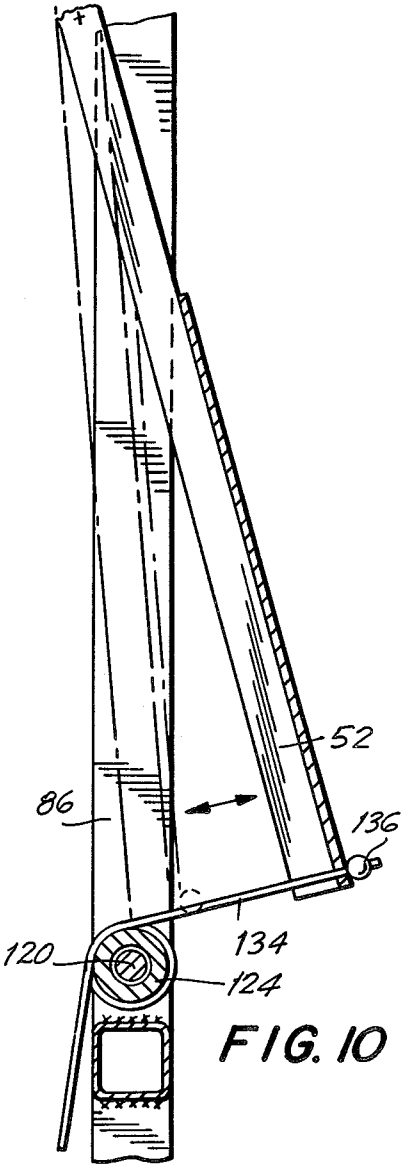
FIG. 10 is a fragmentary view, partly in section, illustrating the connection between a cable of the transport device and a paddle of the variable head tensioning mechanism.

Referring to FIGS. 6, 7 and 10, a hook 130 is secured on each side of the treadle 82. Each hook 130 receives the lower hooked end of a cable connector 132 which is secured, at its upper end, to a steel cable 134. The cables 134 extend upwardly inside the frame 84, seat in the notches of the spools 124, and from there extend outside of the frame 84 for releasable securement to the paddles 52 as more fully explained below.

In use, a conga drum 12 fitted with the head tensioning mechanism 10 of the present invention is seated in the transport device 80. In particular, the lower edge of the outer ring 20 seats on the shoulders 112 of the caps 106 with the paddles 52 extending outside the frame 84 through the lower central cutouts 110. The upper central cutouts 108 in the caps 106 accommodate the flanges 44. The free ends of the cables 134 are passed through aligned apertures in the paddle members 52 and their actuators 66 and secured in place as by beads 136.

It is by now apparent that the transport device 80 may be used in the manner of a handtruck for transporting the drum 12 to any desired location. Once there, the feet 104 are set down and adjusted as necessary. The conga drum is then available for play in the upright position with the player standing. The cable connectors 132 are initially tightened to remove any slack in the cable 134 when the treadle 82 is in the position illustrated by solid lines in FIG. 7. Thereafter, as the player presses down on the treadle 82 with his foot, the cables 134 are pulled down, which in turn pulls the paddles 52 of the tensioning mechanism 10 closer together resulting in additional tension in the drum head 14 as more fully explained above. It will be apparent that the player can continuously adjust the tension of the drum head 14 by simply varying the amount of foot pressure applied to the treadle 82.

When the drum 12 is being played, the handle 116 may be removed. Also, if the conga drum is to be played with the player sitting down, the drum is readily removed from the transport device 80 by simply disconnecting the beads 136 from the ends of the cables 134 and lifting the drum out of the transport device 80.

While we have herein shown and described the preferred embodiments of the present invention and suggested certain modifications thereto, it will be apparent to those of ordinary skill in the art that still further changes and modifications may be made without departing from the spirit and scope of the invention. Such modifications include, but are not limited to, providing means for adjusting the range of movement of the paddles 52, means for further increasing the mechanical advantage of the device, the use of springs to reduce the physical force required to compress the paddles, the use of pneumatic, hydraulic and/or electric power to supply or supplement the force required to compress the paddles, modifications to the device to distribute the tensioning forces more evenly over the drum head, and the application of the tensioning device to other types of drums, such as snare drums, tom-toms, bongos, timbals, etc. Since these as well as still further changes and modifications may be made to the invention without departing from the spirit and scope thereof, the above description should be construed as illustrative, and not in a limiting sense, the scope of the invention being defined by the following claims:

What is claimed is:

1. A variable head tensioning mechanism adapted for retrofitting on a drum of the type comprising a drum body, a drum head overlying one end of the drum body, and a hoop disposed about the drum body near said one end and secured to the periphery of the drum head, said head tensioning mechanism comprising:

an outer ring having an internal diameter greater than the outer diameter of said hoop and securable about said drum body near said one end;

an inner ring seated on said hoop and disposed about said drum body inside said outer ring;

means for securing said inner ring to said outer ring for movement relative thereto;

stop means defining a limit on movement of said inner ring towards said one end of said drum body; and means for moving said inner ring relative to said outer ring towards the other end of said drum body for moving said hoop towards said other end for varying the tension on said drum head.

2. The variable head tensioning mechanism according to claim 1, wherein said means for moving said inner ring comprises a pair of elongate paddles extending along said drum body on opposite sides thereof, and means for securing said paddles to said inner ring for moving said inner ring towards said other end of said drum body as said paddles are moved inwardly towards said drum body.

3. The variable head tensioning mechanism according to claim 2, wherein said means for securing said paddles to said inner ring comprises:

said outer ring having an opening therein on either side of said drum body;

a pair of flanges secured at one end to said inner ring end having a free and extending radially outward beyond said outer ring through said openings therein;

means for pivotally securing one end of said paddles to said outer ring; and a pair of tension rods secured at one end to said free end of said flanges and at the other end to said paddles at a point intermediate the ends thereof.

4. The variable head tensioning mechanism according to claim 3, wherein said stop means comprises the portions of said outer ring above said openings.

5. The variable head tensioning mechanism according to claim 4, wherein said inner ring comprises a pair of half rings disposed about said drum body with their free ends in confronting relation on opposite sides of said drum body; and wherein said means for securing said inner ring to said outer ring for movement relative thereto comprises means for pivotally securing said free ends of said half rings to said outer ring.

6. The variable head tensioning mechanism according to claim 5, wherein said drum is of the type further comprising a means for applying a force on said hoop for tensioning said drum head and wherein said outer ring is securable about said drum body near said one end by said force applying means.

7. The variable head tensioning mechanism according to claim 6, wherein said force applying means comprises a plurality of lugs distributed about said drum body, and wherein said outer ring includes a plurality of apertures for receiving said lugs for securing said outer ring about said drum body.

8. The variable head tensioning mechanism according to claim 2, further comprising means secured to said paddles for effecting movement of said paddles towards said drum body in response to foot pressure.

9. The apparatus accordingly to claim 8, wherein said paddle movement means comprises a foot treadle and means connected at one end to said foot treadle and at the other end to said paddles for moving said paddles towards said drum body upon the application of foot pressure to said treadle.

10. The variable head tensioning mechanism according to claim 9, further comprising a frame for supporting said drum and means for movably securing said treadle to said frame.

11. The variable head tensioning mechanism according to claim 10, further comprising wheels secured to said frame for accomodating transport of said drum on said frame.

12. The variable head tensioning mechanism according to claim 1, wherein said drum is of the type further comprising a means for applying a force on said hoop for tensioning said drum head, and wherein said outer ring is securable about said drum body near said one end by said force applying means.

13. The variable head tensioning mechanism according to claim 12, wherein said force applying means comprises a plurality of lugs distributed about said drum body, and wherein said outer ring includes a plurality of apertures for receiving said lugs for securing said outer ring about said drum body.

14. A mechanism for varying the tension on a drum head comprising:

an outer ring;

an inner ring disposed inside said outer ring;

means for securing said inner ring to said outer ring for movement relative thereto;

stop means defining a limit on movement of said inner ring towards said outer ring in one axial direction; and means for moving said inner ring relative to said outer ring in the other axial direction.

15. The mechanism in accordance with claim 14, wherein said means for moving said inner ring relative to said outer ring comprises a pair of elongate paddles depending from said inner ring and means for securing said paddles to said inner ring for moving said inner ring in said other axial direction as said paddles are moved together.

16. The mechanism according to claim 15, wherein said means for securing said paddles to said inner ring comprises:

said outer ring having an opening therein on either side thereof;

a pair of flanges secured at one end to said inner ring and having a free end extending radially outward beyond said outer ring through said openings therein;

means for pivotally securing one end of said paddles to said outer ring; and a pair of tension rods secured at one end to said free end of said flanges and at the other end to said paddles at a point intermediate the ends thereof.

17. The mechanism according to claim 16, wherein said stop means comprises the portions of said outer ring above said openings.

18. The mechanism according to claim 17, wherein said inner ring comprises a pair of half rings having their free ends in confronting relation; and wherein said means for securing said inner ring to said outer ring for movement relative thereto comprises means for pivotally securing said free ends of said half rings to said outer ring.

19. A drum incorporating a variable head tensioning mechanism, said drum comprising:

a drum body;

a drum head overlying one end of said drum body;

a hoop disposed about said drum body near said one end and secured to the periphery of the drum head;

an outer ring having an internal diameter greater than the outer diameter of said hoop and disposed about said drum body near said one end;

means for securing said outer ring to said drum body;

an inner ring seated on said hoop and disposed about said drum body inside said outer ring;

means for securing said inner ring to said outer ring for movement relative thereto;

stop means defining a limit on movement of said inner ring towards said one end of said drum body; and means for moving said inner ring relative to said outer ring towards the other end of said drum body for moving said hoop towards said other end for varying the tension on said drum head.

20. The drum according to claim 19, wherein said means for securing said outer ring to said drum body further comprises means for adjusting the position of the outer ring in the axial direction.

21. The drum according to claim 19, wherein said means for moving said inner ring comprises a pair of elongate paddles extending along said drum body on opposite sides thereof, and means for securing said paddles to said inner ring for moving said inner ring toward said other end of said drum body as said paddles are moved together.

22. The drum according to claim 21, wherein said means for securing said paddles to said inner ring comprises:

said outer ring having an opening therein on either side of said drum body;

a pair of flanges secured at one end to said inner ring and having a free end extending radially outward beyond said outer ring through said openings therein;

means for pivotally securing one end of said paddles to said outer rings; and a pair of tension rods secured at one end to said free end of said flanges and at the other end to said paddles at a point intermediate the ends thereof.

23. The drum according to claim 22, wherein said stop means comprises the portions of said outer ring above said openings.

24. The drum according to claim 23, wherein said inner ring comprises a pair of half rings disposed about said drum body with their free ends in confronting relation on opposite sides of said drum body; and wherein said means for securing said inner ring to said outer ring for movement relative thereto comprises means for pivotally securing said free ends of said half rings to said outer ring.

* * * * *